US012446650B2

(12) United States Patent
Rathburn et al.

(10) Patent No.: US 12,446,650 B2
(45) **Date of Patent: *Oct. 21, 2025**

(54) UPPER FOR ARTICLE OF FOOTWEAR INCORPORATING A KNITTED BUTTERFLY WORKPIECE

(71) Applicant: LULULEMON ATHLETICA CANADA INC., Vancouver (CA)

(72) Inventors: Samuel Scott Rathburn, Portland, OR (US); Kathryn Carey Fleming, Portland, OR (US); Mark Francis Murphy, Portland, OR (US)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/428,341

(22) Filed: Jan. 31, 2024

(65) Prior Publication Data

US 2024/0164469 A1 May 23, 2024

Related U.S. Application Data

(60) Division of application No. 18/332,092, filed on Jun. 9, 2023, now Pat. No. 11,937,662, which is a (Continued)

(51) Int. Cl.

| | |
|---|---|
| ***A43B 1/04*** | (2022.01) |
| ***A43B 23/02*** | (2006.01) |
| ***D04B 1/10*** | (2006.01) |

(52) U.S. Cl.

CPC ..... *A43B 1/04* (2013.01); *A43B 23/02* (2013.01); *D04B 1/10* (2013.01)

(58) Field of Classification Search

CPC ..... A43B 1/04; A43B 23/02; A43B 23/0245; D04B 1/10; D04B 1/102

See application file for complete search history.

(56) References Cited

U.S. PATENT DOCUMENTS

| | | | |
|---|---|---|---|
| 391,005 | A | 10/1888 | Munsing |
| 1,965,969 | A | 7/1934 | Sturtevant |

(Continued)

FOREIGN PATENT DOCUMENTS

| | | | |
|---|---|---|---|
| JP | 2002/065303 | A | 3/2002 |
| JP | 2002/129401 | A | 5/2002 |

(Continued)

OTHER PUBLICATIONS

Office Action mailed Aug. 18, 2023 in U.S. Appl. No. 18/332,092.

(Continued)

*Primary Examiner* — Bao-Thieu L Nguyen

(74) *Attorney, Agent, or Firm* — Plumsea Law Group, LLC

(57) ABSTRACT

An article of footwear incorporating an upper formed by a forefoot component, a knitted workpiece, and a heel component is described. Each of the forefoot component, the knitted workpiece, and the heel component are separate from each other and joined along connection areas. Reinforcement elements cover the connection areas. In one embodiment, the knitted workpiece includes a collar portion and a throat portion extending from a forward end of the collar portion. The knitted workpiece also includes a medial lobe extending from one side of the throat portion and a lateral lobe extending from an opposite side of the throat portion from the medial lobe. The collar portion, the throat portion, the medial lobe, and the lateral lobe form a single unified knitted workpiece.

19 Claims, 11 Drawing Sheets

Related U.S. Application Data continuation of application No. 17/932,122, filed on Sep. 14, 2022, now Pat. No. 12,150,513.

(56) References Cited

U.S. PATENT DOCUMENTS

| | | | | |
|---|---|---|---|---|
| 2,047,724 | A | 7/1936 | Zuckerman | |
| 2,147,197 | A | 2/1939 | Glidden | |
| 2,675,631 | A | 4/1954 | Carr | |
| 3,641,603 | A | 2/1972 | Lockwood | |
| 4,531,525 | A | 7/1985 | Richards | |
| 4,702,091 | A | 10/1987 | Good et al. | |
| 5,345,638 | A | 9/1994 | Nishida | |
| 6,029,376 | A | 2/2000 | Cass | |
| 6,558,784 | B1 | 5/2003 | Norton et al. | |
| 6,691,535 | B2 | 2/2004 | Gotta et al. | |
| 7,347,011 | B2 | 3/2008 | Dua et al. | |
| 8,448,474 | B1 | 5/2013 | Tatler et al. | |
| 8,806,776 | B2 | 8/2014 | Leick et al. | |
| 9,149,086 | B2 | 10/2015 | Greene et al. | |
| 9,445,640 | B2 | 9/2016 | Dua et al. | |
| 9,642,413 | B2 | 5/2017 | Seamarks et al. | |
| 9,745,678 | B2 | 8/2017 | Podhajny | |
| 9,826,799 | B2 * | 11/2017 | Dojan | A43B 1/028 |
| 10,092,058 | B2 | 10/2018 | Droege et al. | |
| 10,182,617 | B2 | 1/2019 | Craig | |
| 10,258,107 | B2 | 4/2019 | Surace et al. | |
| 10,426,227 | B2 | 10/2019 | Lee et al. | |
| 10,729,208 | B2 | 8/2020 | Podhajny et al. | |
| 10,897,956 | B2 | 1/2021 | Hopkins | |
| 10,918,155 | B2 | 2/2021 | Dekovic et al. | |
| 11,103,029 | B2 | 8/2021 | Verfl et al. | |
| 11,937,662 | B1 * | 3/2024 | Rathburn | D04B 1/102 |
| 2003/0145632 | A1 | 8/2003 | Roe | |
| 2004/0003629 | A1 | 1/2004 | Mitchell | |
| 2005/0193592 | A1 | 9/2005 | Dua et al. | |
| 2010/0154256 | A1 | 6/2010 | Dua | |
| 2012/0318026 | A1 | 12/2012 | Dua et al. | |
| 2013/0219749 | A1 | 8/2013 | Dojan et al. | |
| 2013/0239438 | A1 | 9/2013 | Dua et al. | |
| 2013/0269212 | A1 | 10/2013 | Little | |
| 2014/0130374 | A1 | 5/2014 | Minami et al. | |
| 2014/0130376 | A1 | 5/2014 | Fahmi et al. | |
| 2014/0137433 | A1 * | 5/2014 | Craig | A43B 23/024 66/170 |
| 2014/0173934 | A1 | 6/2014 | Bell | |
| 2014/0259760 | A1 | 9/2014 | Dojan et al. | |
| 2014/0352173 | A1 * | 12/2014 | Bell | A43B 23/0245 28/165 |
| 2015/0075031 | A1 | 3/2015 | Podhajny et al. | |
| 2015/0201707 | A1 | 7/2015 | Bruce | |
| 2015/0282564 | A1 | 10/2015 | Meschter et al. | |
| 2015/0282565 | A1 | 10/2015 | Kilgore | |
| 2016/0174660 | A1 | 6/2016 | Iuchi et al. | |
| 2019/0008234 | A1 | 1/2019 | Christensen et al. | |
| 2019/0365049 | A1 | 12/2019 | Verfl | |
| 2020/0170330 | A1 | 6/2020 | Verfl et al. | |
| 2020/0390194 | A1 * | 12/2020 | Chen | D04B 1/24 |
| 2021/0112915 | A1 | 4/2021 | Hopkins | |
| 2021/0130996 | A1 | 5/2021 | Nordstrom | |
| 2021/0274887 | A1 | 9/2021 | Halligan et al. | |
| 2021/0401106 | A1 | 12/2021 | Thompsett et al. | |
| 2023/0046685 | A1 | 2/2023 | Sussmann | |

FOREIGN PATENT DOCUMENTS

| | | |
|---|---|---|
| WO | 92/22223 | 12/1992 |
| WO | 1998/043506 | 10/1998 |
| WO | 2021171195 A1 | 2/2021 |

OTHER PUBLICATIONS

International Search Report and Written Opinion mailed Jan. 8, 2024 for PCT Application No. PCT/IB2023/000533.

Stoll Sirix 100 / 200 Manual Part 1 and Part 2.

Hong, et al., "The development of 3D shaped knitted fabrics for technical purposes on a flat knitting machine," IJFTR 19(3), Sep. 1994 Niscair-Csir, India.

Susan E. Lewis and Julia Weissman a Machine Knitter's Guide to Creating Fabrics ( Dec. 1986) Larks Books.

* cited by examiner

UPPER FOR ARTICLE OF FOOTWEAR INCORPORATING A KNITTED BUTTERFLY WORKPIECE

CROSS-REFERENCE TO RELATED APPLICATIONS

This application is a division of and claims priority to U.S. patent application Ser. No. 18/332,092, filed on Jun. 9, 2023 and entitled "Upper for Article of Footwear Incorporating a Knitted Butterfly Workpiece", which application is a continuation of and claims priority to U.S. patent application Ser. No. 17/932,122, filed on Sep. 14, 2022 and entitled "Upper for Article of Footwear Incorporating a Knitted Butterfly Workpiece", the content of which applications are hereby incorporated by reference in their entirety.

BACKGROUND

The present embodiments relate generally to an upper for an article of footwear, and, in particular, to an upper for an article of footwear incorporating a knitted butterfly workpiece.

Conventional articles of footwear generally include two primary elements: an upper and a sole assembly. The upper is secured to the sole assembly and forms a void within the footwear for comfortably and securely receiving a foot. The sole assembly is secured to a lower surface of the upper so as to be positioned between the upper and the ground.

Various materials are conventionally utilized in manufacturing the upper. The materials may be selected based upon various properties, including stretch-resistance, wear-resistance, flexibility, air-permeability, compressibility, and moisture-wicking, for example, with each material imparting different properties to the upper.

There is a need in the art for an article of footwear having an upper that provides a combination of properties for an improved fit and feel to a wearer.

SUMMARY

In one aspect, a knitted workpiece for incorporation into an upper of an article of footwear is provided. The knitted workpiece includes a collar portion and a throat portion extending from a forward end of the collar portion. The knitted workpiece also includes a medial lobe extending from one side of the throat portion and a lateral lobe extending from an opposite side of the throat portion from the medial lobe. The collar portion, the throat portion, the medial lobe, and the lateral lobe form a single unified knitted workpiece.

In another aspect, an upper for article of footwear is provided. The upper includes a knitted workpiece disposed in a midfoot region of the upper and at least a portion of a heel region of the upper. The upper also includes a forefoot component disposed in a forefoot region of the upper. The forefoot component is configured to attach to the knitted workpiece along a first attachment area on a medial side and a second attachment area on a lateral side. The upper further includes a heel component disposed in the heel region of the upper. The heel component is configured to attach to the knitted workpiece along a third attachment area on the medial side and a fourth attachment area on the lateral side.

In still another aspect, an article of footwear is provided. The article of footwear includes an upper having a knitted workpiece disposed in a midfoot region of the upper and at least a portion of a heel region of the upper; a forefoot component disposed in a forefoot region of the upper, the forefoot component being configured to attach to the knitted workpiece along a first attachment area on a medial side and a second attachment area on a lateral side, and a heel component disposed in the heel region of the upper, the heel component being configured to attach to the knitted workpiece along a third attachment area on the medial side and a fourth attachment area on the lateral side. The upper also includes a first reinforcement element disposed over the third attachment area on the medial side, a second reinforcement element disposed over both of the first attachment area on the medial side and the second attachment area on the lateral side, and a third reinforcement element disposed over the fourth attachment area on the lateral side. The upper further includes a sole assembly attached to the upper.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

Figure 1:
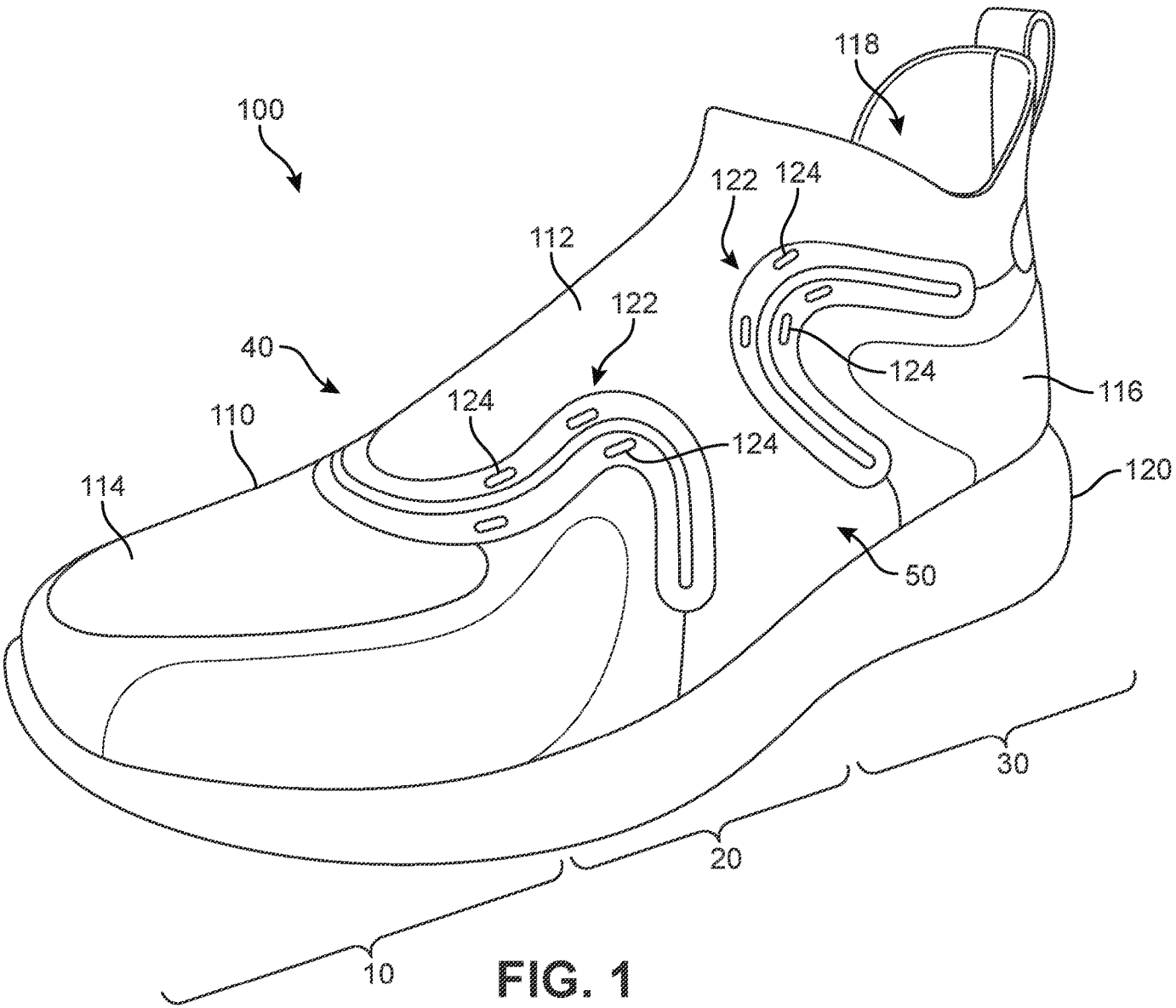
FIG. 1 is an isometric view of an example embodiment of an article of footwear including an upper incorporating a knitted butterfly workpiece.

Articles of footwear having an upper incorporating a knitted butterfly workpiece are described herein. The knitted butterfly workpiece may be combined with additional components to form the upper. The components selected to form the upper may provide a variety of properties to different areas of the article of footwear. The techniques of the present embodiments provide an upper for an article of footwear with improved fit and feel to a foot of a wearer.

For consistency and convenience, directional adjectives are employed throughout this detailed description corresponding to the illustrated embodiments. For purposes of this disclosure, the following directional terms, when used in reference to an article of footwear, shall refer to the article of footwear when sitting in an upright position, with the sole facing the ground, that is, as it would be positioned when worn by a wearer standing on a substantially level surface. The terms "medial," "lateral," "anterior," "posterior," and the like are intended to refer to anatomical directions corresponding to a human on whom an article is configured to be placed or worn. For example, "medial" refers to a relative position disposed toward the center of the human body, while "lateral" refers to a relative position disposed away from the center of the human body. With respect to footwear, the term "anterior" refers to a relative position closer to the toe of a wearer and "posterior" refers to a relative position closer to the heel of the wearer. In the absence of a wearer, the same directional terms may be used as if the article of footwear is being worn in its expected configuration.

The term "longitudinal" as used throughout this detailed description and in the claims refers to a direction extending a length of an article. In some cases, the longitudinal direction may extend from a forefoot region to a heel region of the article. Also, the term "lateral" as used throughout this detailed description and in the claims refers to a direction extending a width of an article. In other words, the lateral direction may extend between a medial side and a lateral side of an article.

Terms such as "up," "down," "vertical," "horizontal," and the like should be understood in the context of the particular article in question. For example, an article may be oriented around defined X, Y, and Z axes, with the X axis corresponding to the longitudinal direction and the Y axis corresponding to the lateral direction. In those examples, the X-Y plane will define horizontal, with up being defined as the positive Z direction and down being defined as the negative Z direction. Furthermore, the term "vertical" as used throughout this detailed description and in the claims refers to a direction generally perpendicular to the X-Y plane and/or the lateral and longitudinal directions. For example, in cases where an article is planted flat on a ground surface, the vertical direction may extend from the ground surface upward. It will be understood that each of these directional adjectives may be applied to individual components of an article, such as an upper and/or a sole structure.

FIGS. 1 through 11 illustrate an example embodiment of an article of footwear 100. For clarity, the following detailed description discusses on example embodiment, in the form of a running shoe, but it should be noted that the techniques described herein could be applied to any form of an article of footwear including, but not limited to: sneakers, training shoes, yoga shoes, soccer shoes, football shoes, basketball shoes, baseball shoes, rugby shoes, other types of sports shoes, casual shoes, hiking boots, as well as other kinds of footwear. As shown in FIGS. 1 through 11, article of footwear 100, also referred to simply as article 100, is intended to be used with a left foot; however, it should be understood that the following discussion may equally apply to a mirror image of article of footwear 100 that is intended for use with a right foot.

Referring to FIGS. 1 through 11, for purposes of reference, article 100 may include forefoot region 10, midfoot region 20 and heel region 30. Forefoot region 10 may be generally associated with the toes and joints connecting the metatarsals with the phalanges. Midfoot region 20 may be generally associated with the arch of a foot. Likewise, heel region 30 may be generally associated with the heel of a foot, including the calcaneus bone. In addition, article 100 may include medial side 40 and lateral side 50. In particular, medial side 40 and lateral side 50 may be opposing sides of article 100. Furthermore, both medial side 40 and lateral side 50 may extend through forefoot region 10, midfoot region 20 and heel region 30.

It will be understood that forefoot region 10, midfoot region 20 and heel region 30 are only intended for purposes of description and are not intended to demarcate precise regions of article 100, but rather, to describe relative positions. Likewise, medial side 40 and lateral side 50 are intended to represent generally two sides of an article, rather than precisely demarcating article 100 into two halves. In addition, forefoot region 10, midfoot region 20 and heel region 30, as well as medial side 40 and lateral side 50, can also be applied to individual components of an article, such as a sole assembly and/or an upper.

Article 100 may include an upper 110 and a sole assembly 120. In some embodiments, sole assembly 120 may be configured to provide traction for article 100. In addition to providing traction, sole assembly 120 may attenuate ground reaction forces when compressed between the foot and the ground during walking, running or other ambulatory activities. The configuration of sole assembly 120 may vary significantly in different embodiments to include a variety of conventional or non-conventional structures. In some cases, the configuration of sole assembly 120 can be configured according to one or more types of ground surfaces on which sole assembly 120 may be used. Examples of ground surfaces include, but are not limited to: dirt, concrete, pavement, natural turf, synthetic turf, as well as other surfaces.

Sole assembly 120 is secured to upper 110 and extends between the foot and the ground when article 100 is worn. In different embodiments, sole assembly 120 may include different components. For example, sole assembly 120 may include an outsole, a midsole, and/or an insole. In some cases, one or more of these components may be optional. Moreover, in some cases, sole assembly 120 may itself be optional.

Upper 110 may be generally configured to receive and cover a foot. In some embodiments, upper 110 may incorporate a knitted workpiece 112. In an example embodiment, knitted workpiece 112 may extend through a majority of midfoot region 20 of upper 110 and at least a portion of heel region 30. In one embodiment, knitted workpiece 112 is a single unified knitted workpiece formed of a unified knit composition made by a looping at least one continuous yarn/thread into a plurality of rows that define a shape of knitted workpiece 112. Unified knitted workpiece 112 may be incorporated into upper 110 and may be combined with additional components to form upper 110 of article of footwear 100. These additional components may include one or more separate workpieces that form portions of upper 110 when combined with unified knitted workpiece 112.

For example, in some embodiments, knitted workpiece 112 may be combined with a forefoot component 114 and/or a heel component 116. In one embodiment, forefoot component 114 extends through a majority of forefoot region 10 of upper 110 and heel component 116 extends through a majority of heel region 30 of upper 110. Each of forefoot component 114 and heel component 116 are made separately from knitted workpiece 112 and are joined or attached to knitted workpiece 112 to form upper 110.

The additional components may also include one or more yarns/threads forming seams through stitching to join portions of unified knitted workpiece 112 together and/or to attach other components, which may be formed separately of similar or dissimilar materials, including forefoot component 114 and/or heel component 116. Additional components may also include structural elements, such as covering layers, substrate layers, reinforcement members, laces, cushioning or padding, overlays, etc. and/or decorative elements, such as designs, logos, pictures, colored overlays or films, etc. Other techniques, such as bonding using adhesives, heat, and/or pressure, or overmolding may be used to attach components to upper 110, including knitted workpiece 112 and/or other workpieces, such as forefoot component 114 and/or heel component 116, to form upper 110.

As described above, knitted workpiece 112 may be made of a unified knit composition and the additional components are formed separately of similar or dissimilar materials. In an example embodiment, forefoot component 114 and/or heel component 116 may be made from one or more material elements, including but not limited to textiles, leather, synthetic leather, polymer sheets, and including combinations thereof, that are joined through stitching or bonding, for example. Together, knitted workpiece 112, forefoot component 114, and heel component 116 form upper 110.

In some embodiments, upper 110 may include an opening 118 that provides entry to an interior of upper 110 and/or article 100. In an example embodiment, knitted workpiece 112 may extend longitudinally from opening 118 through an instep area of upper 110 in a direction towards forefoot region 10 where forefoot component 114 and knitted workpiece 112 are attached.

In addition, upper 110 may include a plurality of reinforcement elements 122 that are located along connection areas of upper 110 where knitted workpiece 112 is attached or joined with forefoot component 114 and/or heel component 116. In an example embodiment, reinforcement elements 122 may be located at a connection area of upper 110 generally between forefoot region 10 and midfoot region 20 where forefoot component 114 and knitted workpiece 112 meet and also at a connection area of upper 110 generally between midfoot region 20 and heel region 30 where heel component 116 and knitted workpiece 112 meet. In some embodiments, plurality of reinforcement elements 122 may cover and provide reinforcement and/or structural support to the seam or joint at the connection areas where the separate components are joined or attached to form upper 110.

In some embodiments, plurality of reinforcement elements 122 may also include provisions for tightening or otherwise fastening upper 110 and article 100 to a foot of a wearer. Although not shown in the present embodiments, some embodiments of article 100 may include a lace or other fastening member that may be used to adjust the fit of upper 110 around a foot of a wearer. For example, plurality of reinforcement elements 122 may be provided with a plurality of apertures 124 that are configured to receive a lace for tightening upper 110.

Figure 2:
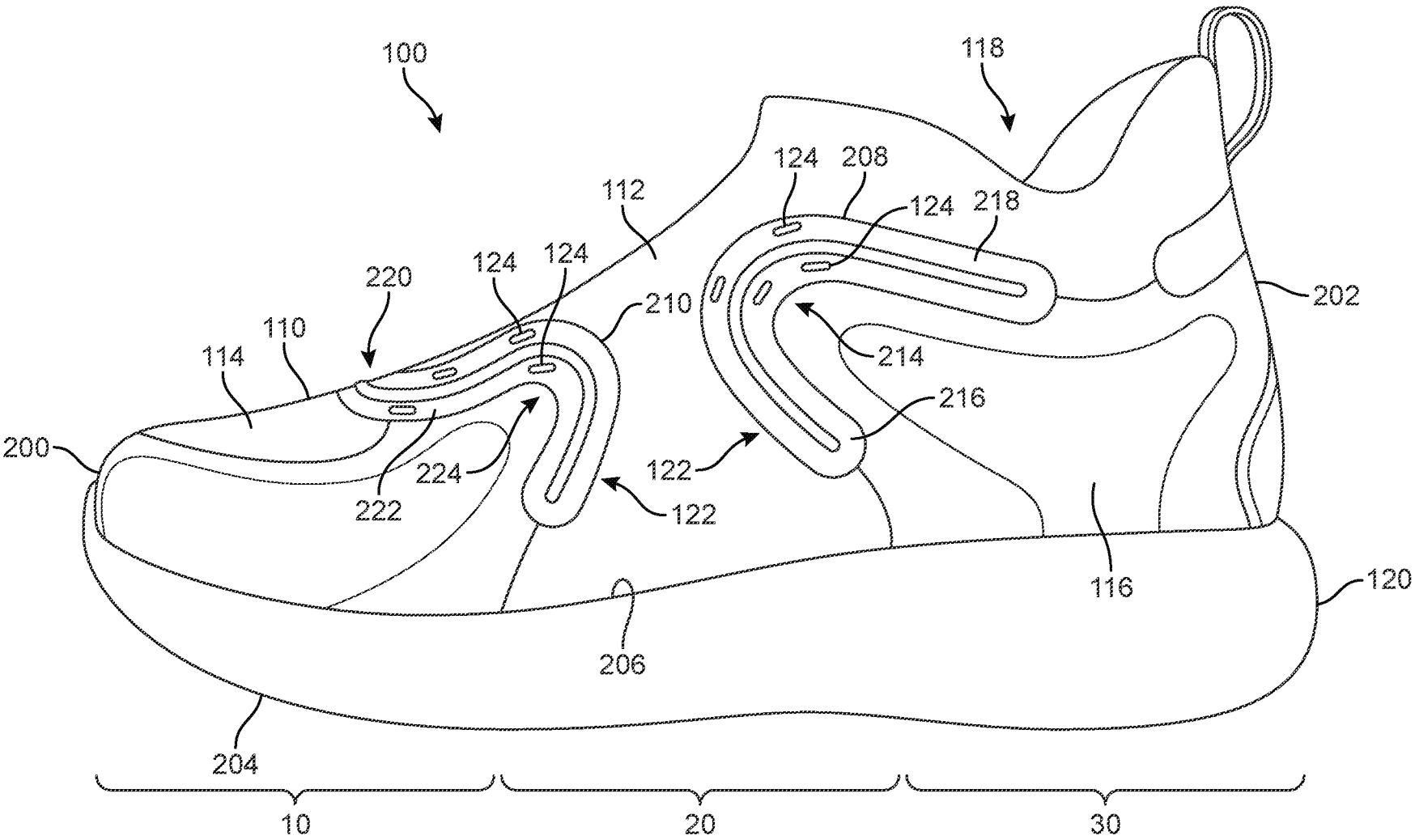
FIG. 2 is a lateral side view of the example embodiment of an article of footwear including an upper incorporating a knitted butterfly workpiece.

FIG. 2 illustrates lateral side 50 of article 100. In an example embodiment, upper 110 of article 100 extends from a toe end 200 located at a front portion of article 100 to a heel end 202 located at a rear portion of article 100 longitudinally opposite toe end 200. In one embodiment, sole assembly 120 extends from toe end 200 to heel end 202 through each of forefoot region 10, midfoot region 20, and heel region 30 of article 100. As shown in FIG. 2, sole assembly 120 includes a lower surface 204 that extends along a bottom of sole assembly 120. In an example embodiment, lower surface 204 of sole assembly 120 is configured to contact a ground surface when article 100 is worn. In one embodiment, sole assembly 120 may extend in a vertical direction from lower surface 204 to an upper edge 206 that is adjacent to upper 110 of article 100. In some cases, upper edge 206 may define a bite line or boundary where upper 110 and sole assembly 120 meet on each side of article 100 (e.g., on medial side 40 and lateral side 50).

In an example embodiment, article 100 includes plurality of reinforcement elements 122 that are located along connection areas of upper 110 where knitted workpiece 112 is attached or joined with forefoot component 114 and/or heel component 116. As shown in FIG. 2, plurality of reinforcement elements 122 includes at least a first reinforcement element 208 disposed on lateral side 50. First reinforcement element 208 is located along a connection area where knitted workpiece 112 is attached or joined with heel component 116. First reinforcement element 208 covers and overlays a seam or joint between knitted workpiece 112 and heel component 116 and provides reinforcement and structural support to the connection area joining the separate components.

In one embodiment, first reinforcement element 208 has a generally curving U-shape with a bend 214 separating a first portion 216 that extends vertically along lateral side 50 towards sole assembly 120 and a second portion 218 that extends longitudinally along lateral side 50 in a direction towards heel end 202.

Plurality of reinforcement elements 122 may also include a second reinforcement element 210. Second reinforcement element 210 extends across a top portion of upper 110 from lateral side 50 to the opposite medial side 40. Second reinforcement element 210 is located along a connection area where knitted workpiece 112 is attached or joined with forefoot component 114. Second reinforcement element 210 covers and overlays a seam or joint between knitted workpiece 112 and forefoot component 114 and provides reinforcement and structural support to the connection area joining the separate components.

In one embodiment, second reinforcement element 210 has a generally curving U-shape with a center portion 220 located approximately in a middle of the top portion of upper 110 separating a first curving portion 222 that extends longitudinally along lateral side 50 in a direction away from toe end 200 before changing direction at a lateral bend 224 and extending downwards towards sole assembly 120.

Figure 3:
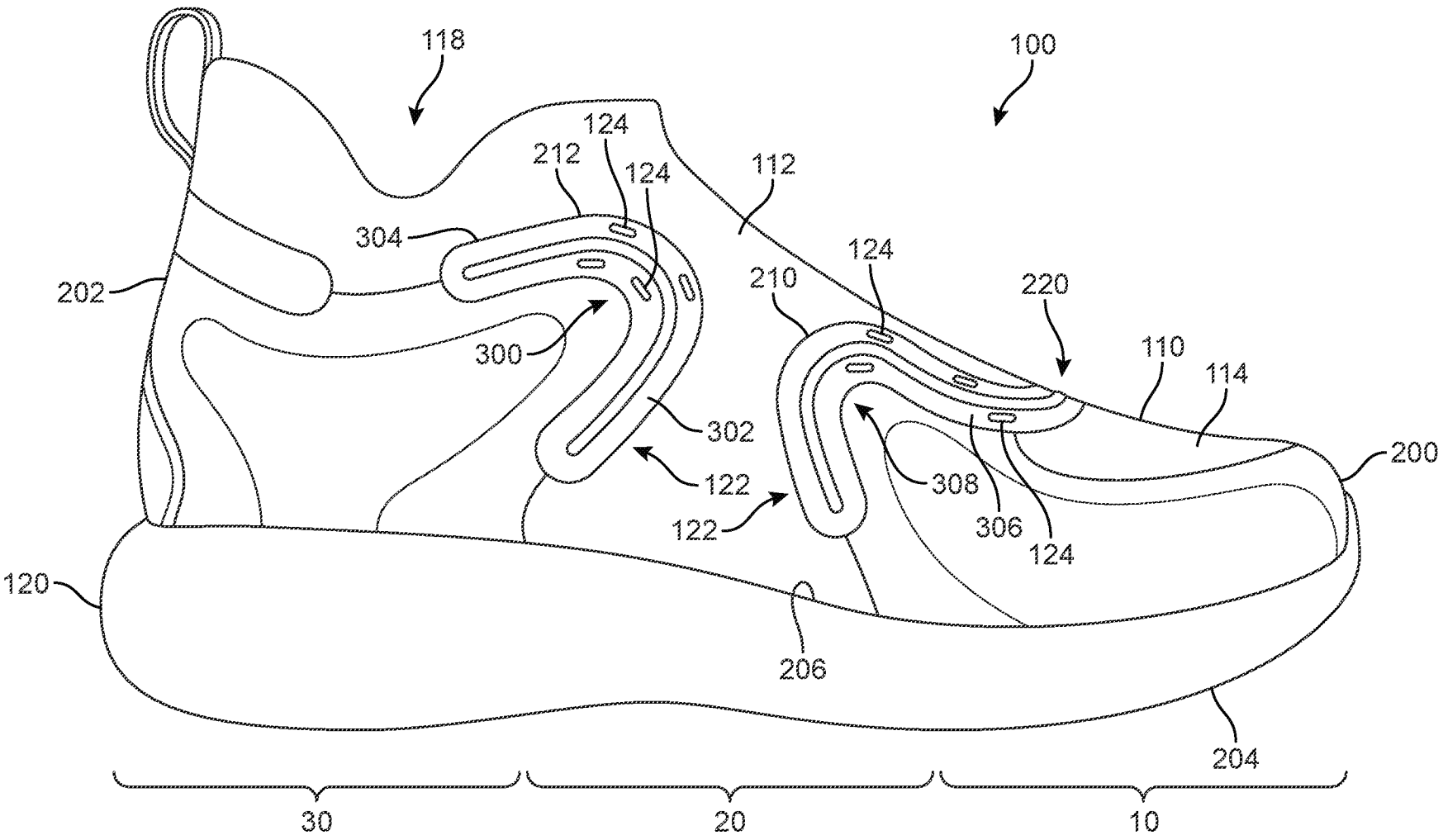
FIG. 3 is a medial side view of the example embodiment of an article of footwear including an upper incorporating a knitted butterfly workpiece.

FIG. 3 illustrates medial side 40 of article 100. In an example embodiment, upper 110 may have a similar arrangement on each of medial side 40 and lateral side 50. In other embodiments, upper 110 of article 100 may have an asymmetrical arrangement so that portions of upper 110 on medial side 40 are different from portions of upper 110 on lateral side 50. In addition, in this embodiment, sole assembly 120 has a substantially similar arrangement on each of medial side 40 and lateral side 50. For example, as shown in FIG. 3, sole assembly 120 extends in a vertical direction from lower surface 204 to upper edge 206 that is adjacent to upper 110 of article 100 on medial side 40 in a similar manner as on lateral side 50. However, in other embodiments, sole assembly 120 may extend to different heights in the vertical direction on medial side 40 and lateral side 50 of upper 110.

As shown in FIG. 3, plurality of reinforcement elements 122 also includes a third reinforcement element 212 disposed on medial side 40. Third reinforcement element 212 is located along a connection area where knitted workpiece 112 is attached or joined with heel component 116. With this arrangement, third reinforcement element 212 covers and overlays a seam or joint between knitted workpiece 112 and heel component 116 and provides reinforcement and structural support to the connection area joining the separate components.

In one embodiment, third reinforcement element 212 has a generally curving U-shape with a bend 300 separating a first portion 302 that extends vertically along medial side 40 towards sole assembly 120 and a second portion 304 that extends longitudinally along medial side 40 in a direction towards heel end 202. In an example embodiment, third reinforcement element 212 is disposed on medial side 40 directly opposite from first reinforcement element 208 on lateral side 50. In some cases, third reinforcement element 212 and first reinforcement element 208 may be similarly shaped so as to be symmetrical on each of medial side 40 and lateral side 50. In other cases, the shapes and/or arrangements of third reinforcement element 212 and first reinforcement element 208 on each of medial side 40 and lateral side 50 may be different so as to be asymmetrical on opposite sides of upper 110.

As shown in FIG. 3, second reinforcement element 210 extends across the top portion of upper 110 from medial side 40 to the opposite lateral side 50. Second reinforcement element 210 is located along a connection area where knitted workpiece 112 is attached or joined with forefoot component 114. Second reinforcement element 210 covers and overlays a seam or joint between knitted workpiece 112 and forefoot component 114 and provides reinforcement and structural support to the connection area joining the separate components. In one embodiment, second reinforcement element 210 has a generally curving U-shape with center portion 220 located approximately in a middle of the top portion of upper 110 separating a second curving portion 306 that extends longitudinally along medial side 40 in a direction away from toe end 200 before changing direction at a medial bend 308 and extending downwards towards sole assembly 120.

Figure 4:
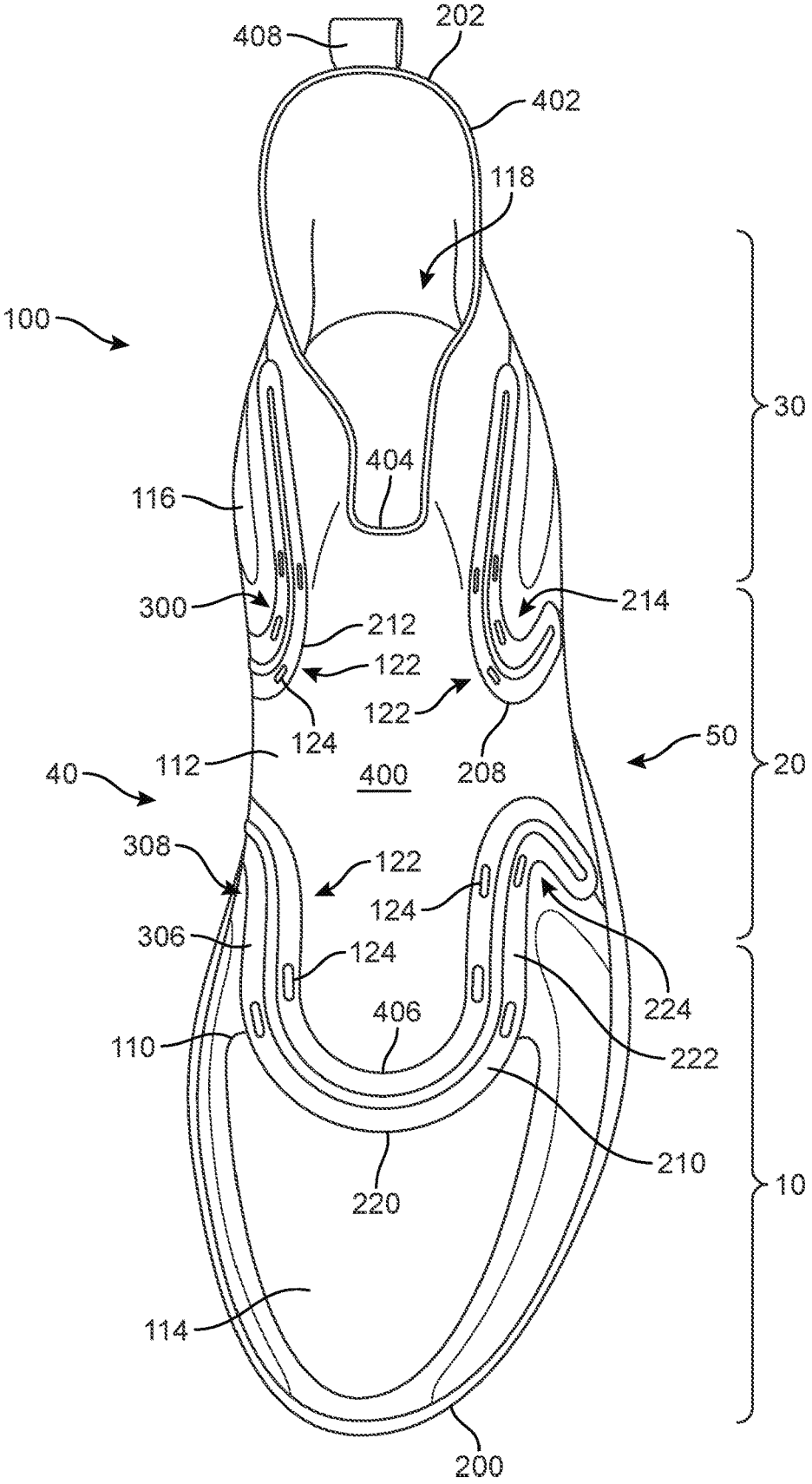
FIG. 4 is a top down view of the example embodiment of an article of footwear including an upper incorporating a knitted butterfly workpiece.

Referring now to FIG. 4, a top down view of article 100 and upper 110 is shown. In some embodiments, upper 110 may be formed from a combination of separately or individually manufactured components that are combined to assembly upper 110. In an example embodiment, upper 110 includes forefoot component 114, knitted workpiece 112, and heel component 116. In this embodiment, knitted workpiece 112 extends through a majority of midfoot region 20 and a portion of heel region 30.

In an example embodiment, knitted workpiece 112 includes a throat portion 400 and a collar portion 402. Throat portion 400 of knitted workpiece 112 extends forward from opening 118 through an instep area of upper 110 in a direction towards forefoot region 10 where forefoot component 114 and knitted workpiece 112 are attached. Collar portion 402 of knitted workpiece 112 extends rearward from throat portion 400 and encircles or surrounds opening 118. In an example embodiment, collar portion 402 includes a forward end 404 where throat portion 400 begins and is joined along a seam at a rear end opposite forward end 404. In one embodiment, a tab 408 may be located at the rear end of collar portion 402 to cover the seam joining the rear edges of collar portion 402 and to assist a wearer when inserting a foot into opening 118 of article 100.

In this embodiment, throat portion 400 of knitted workpiece 112 extends longitudinally from forward end 404 of collar portion 402 at opening 118 through the instep area of upper 110 to a front end 406 of throat portion 400 in a direction towards forefoot region 10. In some embodiments, plurality of reinforcement elements 122 are configured to cover and/or overlay the connection areas between the separate components of upper 110. For example, first reinforcement element 208 and third reinforcement element 212 are configured to cover and reinforce the connection area between knitted workpiece 112 and heel component 116 and second reinforcement element 210 is configured to cover and reinforce the connection area between knitted workpiece 112 and forefoot component 114. As shown in FIG. 4, front end 406 of throat portion 400 is disposed at or adjacent to center portion 220 of second reinforcement element 210 where knitted workpiece 112 and forefoot component 114 are joined or attached to each other. In an example embodiment, throat portion 400 of knitted workpiece is configured to cover an instep of a foot of a wearer of article 100. In other embodiments, however, a tongue may be provided.

Figure 5:
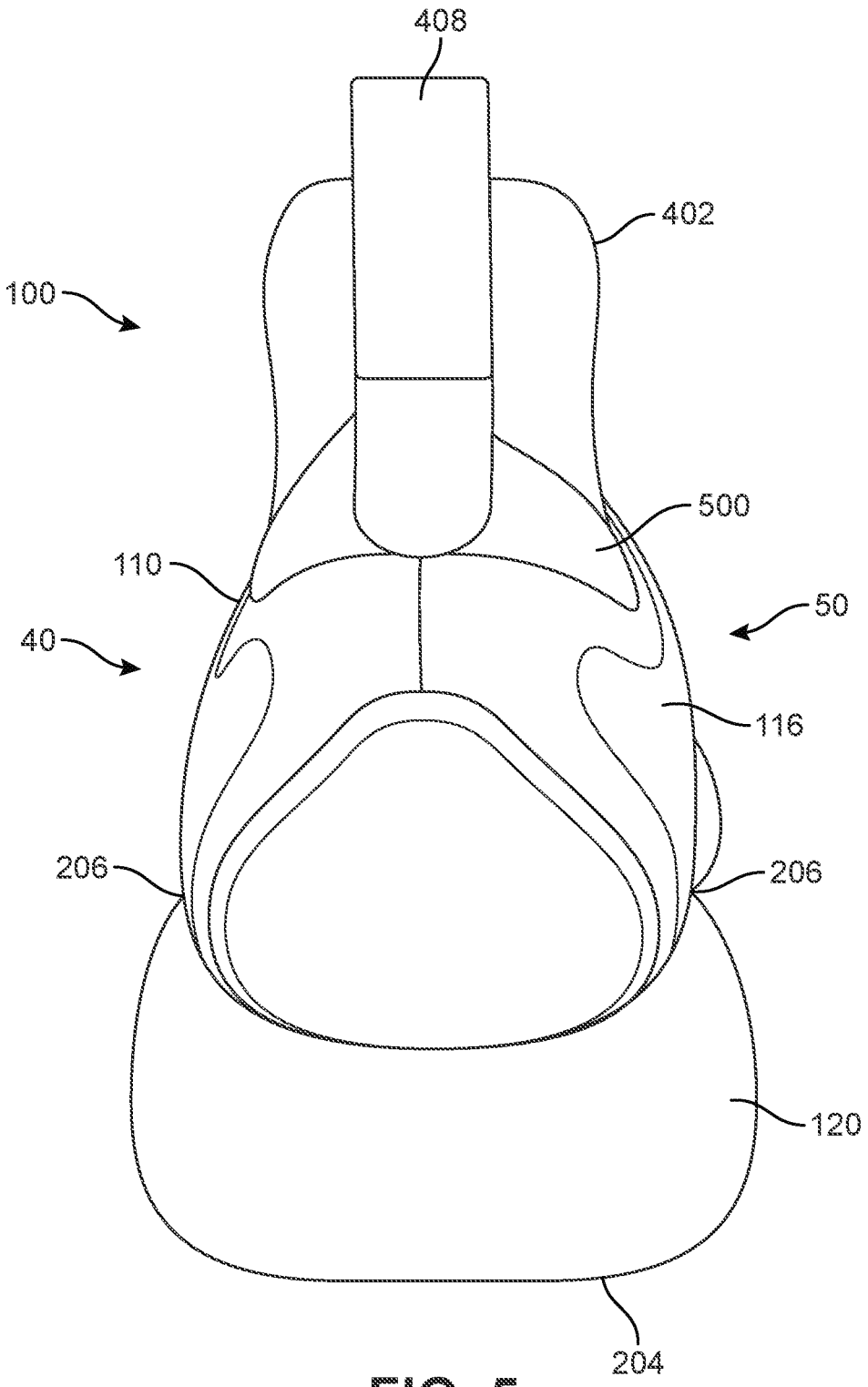
FIG. 5 is a rear view of the example embodiment of an article of footwear including an upper incorporating a knitted butterfly workpiece.

FIG. 5 is a rear view of the example embodiment of article of footwear 100 including upper 110 incorporating knitted workpiece 112. In this embodiment, tab 408 covering the seam joining the two sides of collar portion 402 of knitted workpiece 112 that are joined along the rear of upper 110 is shown. In some embodiments, an overlay 500 may be disposed over or along a connection area at the rear of upper 110 where collar portion 402 of knitted workpiece 112 and heel component 116 are joined or attached. In this embodiment, overlay 500 is a thin piece of thermoplastic polymer or similar film-like material that may be attached over the connection area between knitted workpiece 112 and heel component 116 using heat and/or pressure to bond with the surfaces of knitted workpiece 112 and heel component 116. In other embodiments, adhesive or other types of attachment may be used, such as stitching.

Figure 6:
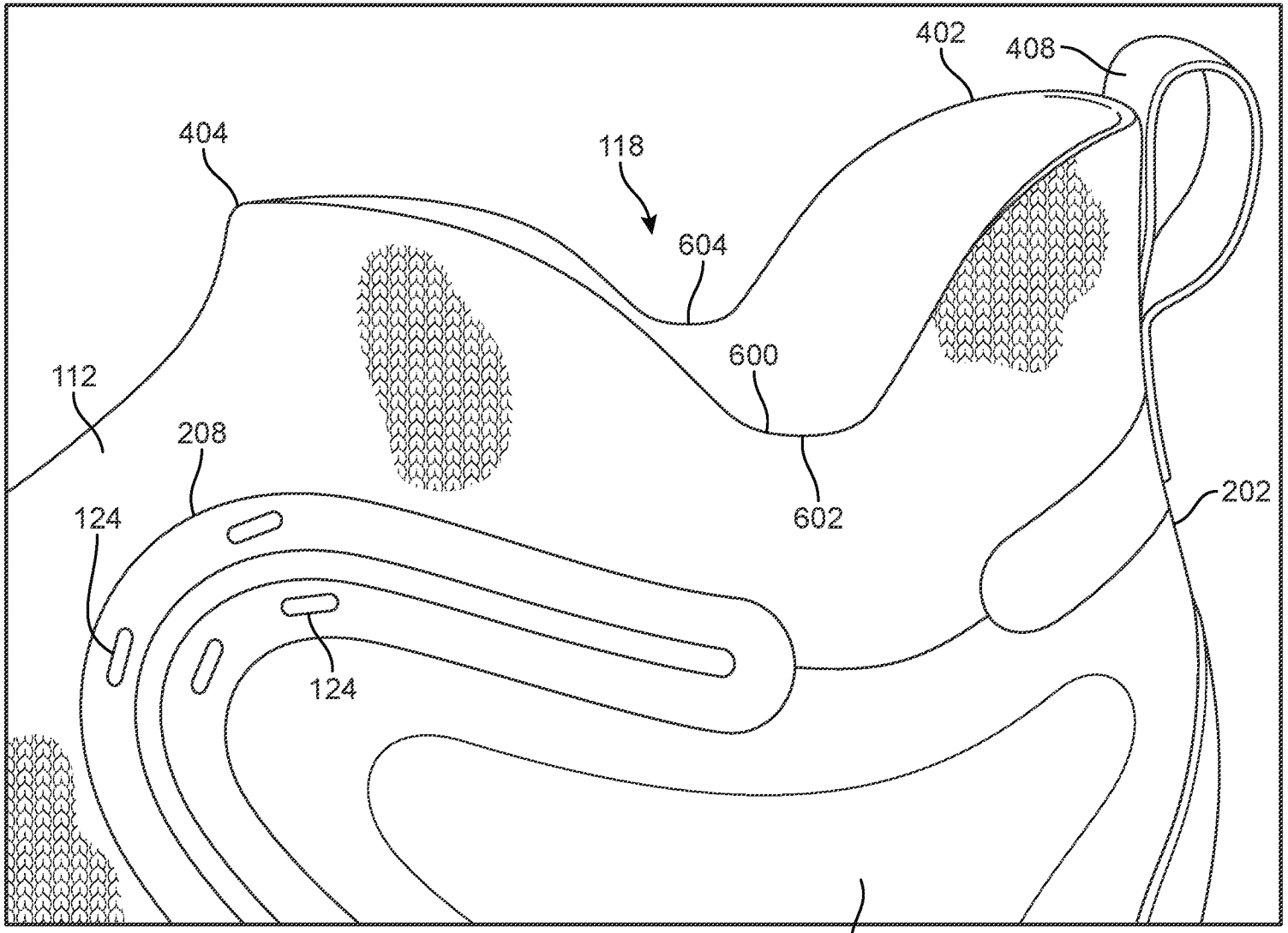
FIG. 6 is an enlarged view of a collar portion of an example embodiment of a knitted butterfly workpiece.

Referring now to FIG. 6, an enlarged view of collar portion 402 of knitted workpiece 112 is shown. In some embodiments, collar portion 402 of knitted workpiece 112 may have an asymmetrical arrangement between medial side 40 and lateral side 50. For example, as shown in FIG. 6, an upper edge 600 of collar portion 402 extends around and encircles opening 118. On each of medial side 40 and lateral side 50 a notch is provided in upper edge 600 of collar portion 402 to accommodate an ankle of a foot of a wearer. In this embodiment, upper edge 600 of collar portion 402 includes a lateral notch 602 on lateral side 50 of collar portion 402 and a medial notch 604 on medial side 40 of collar portion 402.

In one embodiment, lateral notch 602 and medial notch 604 may have an asymmetrical arrangement such that lateral notch 602 and medial notch 604 have different locations in a longitudinal direction (i.e., closer or farther from heel end 202 of article 100) and/or have different heights in a vertical direction (i.e., closer or farther from sole assembly 120). As shown in FIG. 6, lateral notch 602 is located closer to heel end 202 of article 100 than medial notch 604 (e.g., lateral notch 602 is located rearward of medial notch 604) along a longitudinal direction of upper 110 and article 100.

Additionally, in this embodiment, lateral notch 602 extends a distance from upper edge 600 of collar portion 402 towards sole assembly 120 that is greater than a distance that medial notch 604 extends from upper edge 600 (e.g., lateral notch 602 extends downward in the vertical direction farther than medial notch 604). That is, lateral notch 602 is closer to sole assembly 120 than medial notch 604). This asymmetrical arrangement of lateral notch 602 and medial notch 604 on collar portion 402 of knitted workpiece 112 accommodates an ankle of a foot of a wearer. In other embodiments, however, the arrangement of lateral notch 602 and medial notch 604 may be different, including configurations where medial notch 604 is closer to heel end 202 and/or is closer to sole assembly 120 than lateral notch 602. In still other embodiments, lateral notch 602 and medial notch 604 may have a substantially similar arrangement on each of lateral side 50 and medial side 40 so as to be symmetrical.

Figure 7:
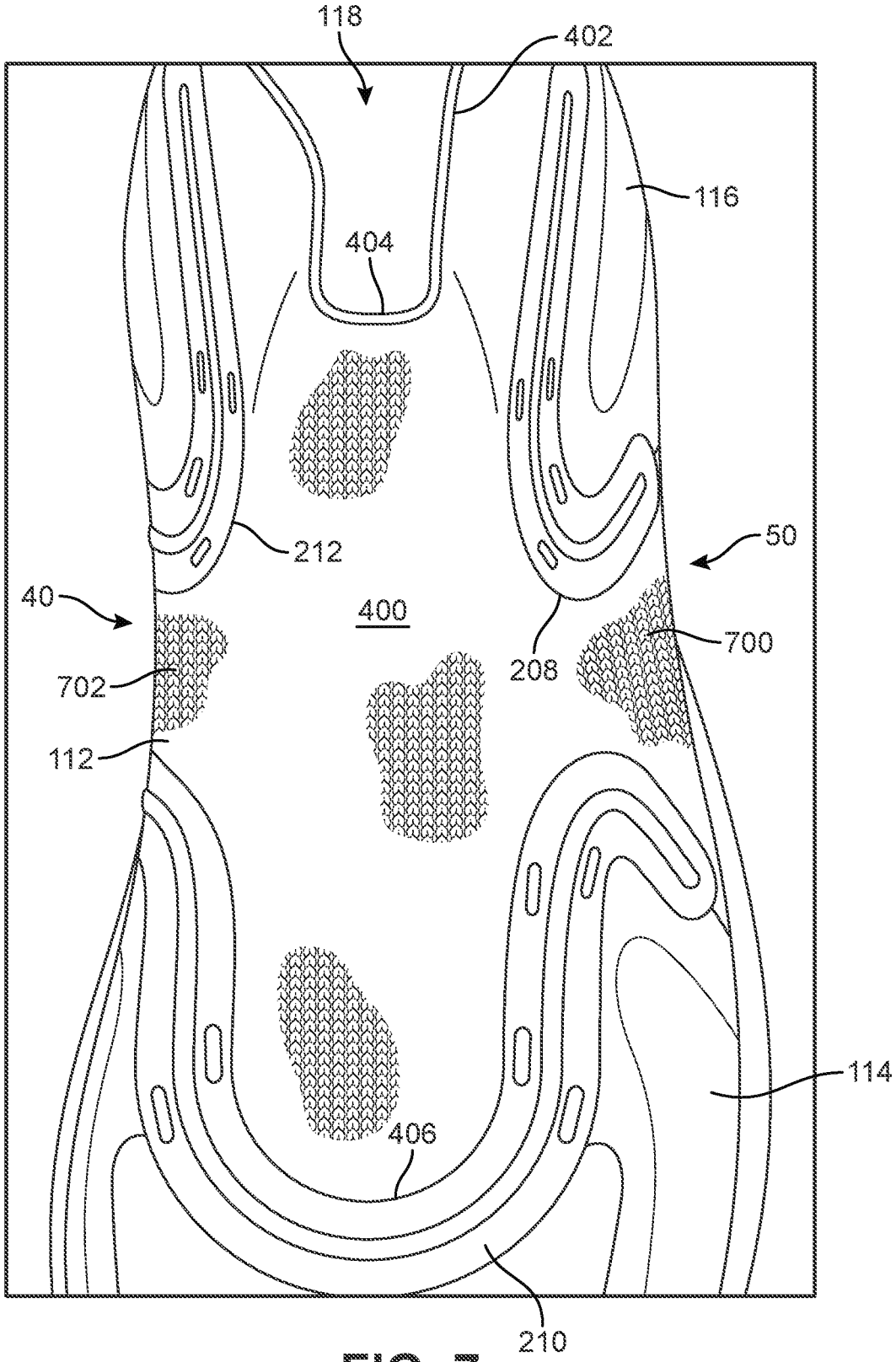
FIG. 7 is an enlarged view of a throat portion of an example embodiment of a knitted butterfly workpiece.

In some embodiments, knitted workpiece 112 may have a butterfly-like arrangement with portions extending out from throat portion 400 in a lateral direction that form at least a portion of medial side 40 and lateral side 50 of upper 110. Referring now to FIG. 7, an enlarged view of throat portion 400 of knitted butterfly workpiece 112 is shown. In this embodiment, throat portion 400 of knitted butterfly workpiece 112 extends longitudinally from forward end 404 of collar portion 402 to front end 406. In some embodiments, knitted butterfly workpiece 112 may further include portions that extend laterally outward from sides of throat portion 400 in a direction towards medial side 40 and lateral side 50.

In an example embodiment, knitted butterfly workpiece 112 includes a lateral lobe 700 that extends outward in a lateral direction from one side of throat portion 400 and a medial lobe 702 that extends outward in a lateral direction from the opposite side of throat portion 400. In some embodiments, lateral lobe 700 and medial lobe 702 are configured to be joined to separate forefoot component 114 along a front side of lateral lobe 700 and medial lobe 702 and to separate heel component 116 along a rear side of lateral lobe 700 and medial lobe 702. With this arrangement, lateral lobe 700 of knitted butterfly workpiece 112 forms at least a portion of upper 110 on lateral side 50 of article 100 and medial lobe 702 of knitted butterfly workpiece 112 forms at least a portion of upper 110 on medial side 40 of article 100.

As described above, in some embodiments, upper 110 is formed by multiple separate components that are joined along connection areas to assemble upper 110. For example, in an example embodiment, upper 110 is formed by knitted butterfly workpiece 112 that is joined or attached to separate forefoot component 114 and separate heel component 116 along a plurality of connection areas where portions of knitted workpiece 112 meet or abut with portions of forefoot component 114 and/or portions of heel component 116. In some embodiments, upper 110 may include provisions for reinforcement at the plurality of connection areas, for example, plurality of reinforcement elements 122, that are configured to overlay the connection areas and provide reinforcement and structural support to the connection areas on upper 110.

Figure 8:
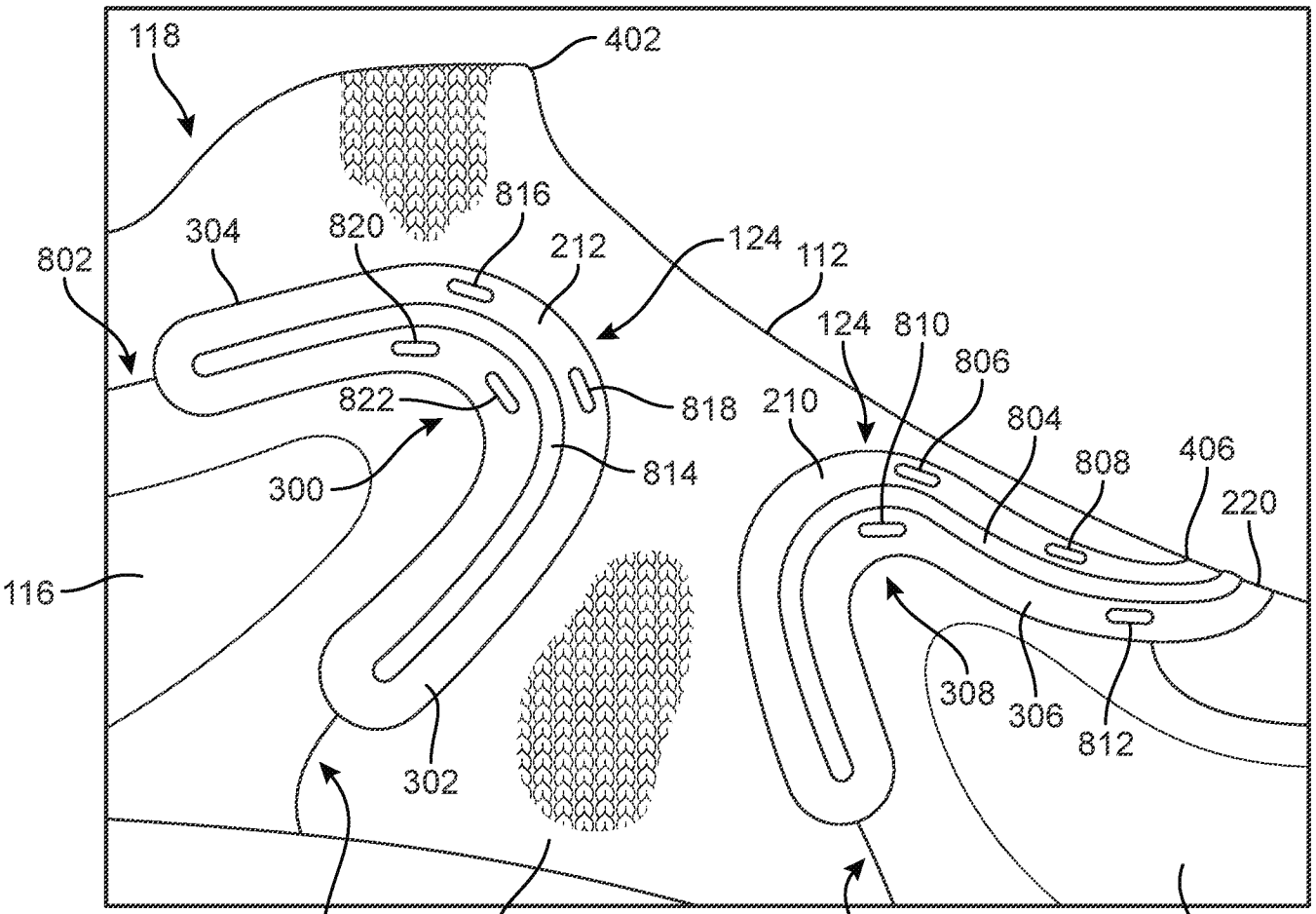
FIG. 8 is an enlarged view of a medial side of an example embodiment of a knitted butterfly workpiece.

Referring now to FIG. 8, an enlarged view of medial side 40 of knitted butterfly workpiece 112 is shown. In this embodiment, a portion of second reinforcement element 210 covers and reinforces a first connection area 800 between knitted workpiece 112 and forefoot component 114 and third reinforcement element 212 covers and reinforces a third connection area 802 between knitted workpiece 112 and heel component 116. In particular, first portion 302 of third reinforcement element 212 covers and reinforces a portion of third connection area 802 between medial lobe 702 of knitted workpiece 112 and heel component 116 and second portion 304 of third reinforcement element 212 covers and reinforces a portion of third connection area 802 between collar portion 402 of knitted workpiece 112 and heel component 116.

Medial lobe 702 of knitted workpiece 112 is joined with forefoot component 114 at first connection area 800 that extends along a front side of medial lobe 702. Medial lobe 702 of knitted workpiece 112 is joined with heel component 116 at third connection area 802 that extends along a rear side of medial lobe 702. As shown in FIG. 8, a portion of second reinforcement element 210 is disposed over first connection area 800 and third reinforcement element 212 is disposed over third connection area 802.

In some embodiments, the reinforcement elements may include a ridge that extends approximately through the middle of each reinforcement element to provide structural rigidity to the reinforcement element. For example, as shown in FIG. 8, second reinforcement element 210 includes a first ridge 804 and third reinforcement element 212 includes a second ridge 814. In some cases, first ridge 804 and second ridge 814 may be formed by molding the ridge into the material forming the respective reinforcement element, for example, a rigid plastic or polymer material. In other cases, first ridge 804 and second ridge 814 may be a separate element or piece that is attached or bonded to the reinforcement elements, such as a length of metal wire, rigid plastic, or other generally inflexible material to provide structural rigidity to each respective reinforcement element.

In some embodiments, the reinforcement elements, including second reinforcement element 210 and/or third reinforcement element 212, may be provided with plurality of apertures 124, as described above, configured to receive a lace. In this embodiment, the portion of second reinforcement element 210 on medial side 40 includes a first lace aperture 806 and a second lace aperture 808 that are disposed on one side of first ridge 804 (e.g., located above first ridge 804). The portion of second reinforcement element 210 on medial side 40 also includes a third lace aperture 810 and a fourth lace aperture 812 that are disposed on an opposite side of first ridge 804 from first lace aperture 806 and second lace aperture 808 (e.g., located beneath first ridge 804). With this arrangement, a force applied to a lace extending through one or more of first lace aperture 806, second lace aperture 808, third lace aperture 810, and fourth lace aperture 812 may be distributed across second reinforcement element 210 on either side of first ridge 804.

Additionally, in this embodiment, third reinforcement element 212 includes a fifth lace aperture 816 and a sixth lace aperture 818 that are disposed on one side of second ridge 814 (e.g., located above second ridge 814) and a seventh lace aperture 820 and an eighth lace aperture 822 that are disposed on an opposite side of second ridge 814 from fifth lace aperture 816 and sixth lace aperture 818 (e.g., located beneath second ridge 814). With this arrangement, a force applied to a lace extending through one or more of fifth lace aperture 816, sixth lace aperture 818, seventh lace aperture 820, and eighth lace aperture 822 may be distributed across third reinforcement element 212 on either side of second ridge 814.

In some embodiments, a central portion of throat portion 400 of knitted workpiece 112, including medial lobe 702, is substantially free of lace apertures. That is, as shown in FIG. 8, an area on knitted workpiece 112 that includes medial lobe 702 located between third reinforcement element 212 and the portion of second reinforcement element 210 on medial side 40 does not include any lace apertures of plurality of apertures 124. With this arrangement, medial lobe 702 of knitted workpiece 112 may allow the sides of a foot of a wearer to flex and bulge when article 100 is worn during an activity, such as running or walking.

Figure 9:
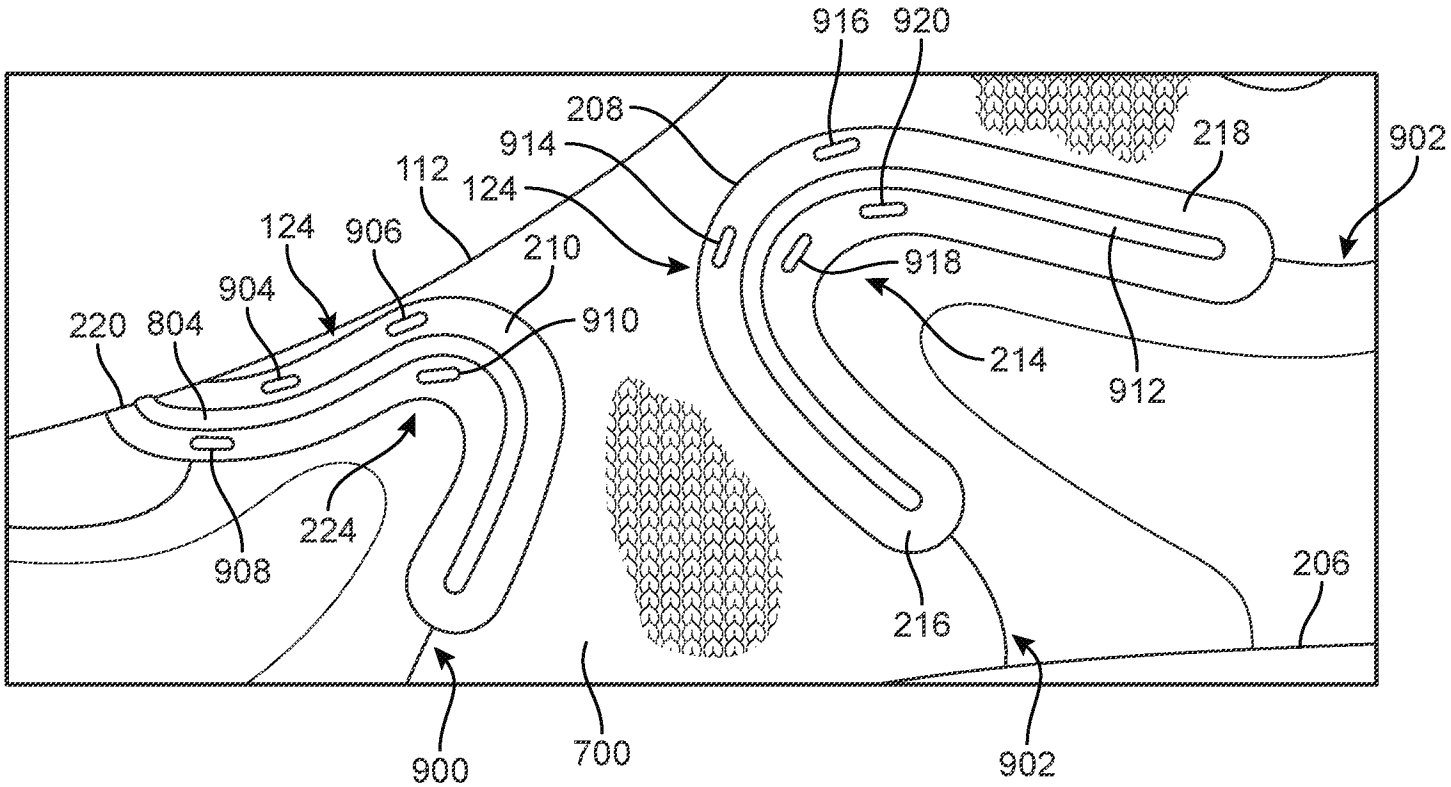
FIG. 9 is an enlarged view of a lateral side of an example embodiment of a knitted butterfly workpiece.

FIG. 9 shows an enlarged view of lateral side 50 of knitted butterfly workpiece 112. In this embodiment, a portion of second reinforcement element 210 covers and reinforces a second connection area 900 between knitted workpiece 112 and forefoot component 114 and first reinforcement element 208 covers and reinforces a fourth connection area 902 between knitted workpiece 112 and heel component 116. Lateral lobe 700 of knitted workpiece 112 is joined with forefoot component 114 at second connection area 900 that extends along a front side of lateral lobe 700. In particular, first portion 216 of first reinforcement element 208 covers and reinforces a portion of fourth connection area 902 between lateral lobe 700 of knitted workpiece 112 and heel component 116 and second portion 218 of first reinforcement element 208 covers and reinforces a portion of fourth connection area 902 between collar portion 402 of knitted workpiece 112 and heel component 116.

Lateral lobe 700 of knitted workpiece 112 is joined with heel component 116 at fourth connection area 902 that extends along a rear side of lateral lobe 700. As shown in FIG. 9, a portion of second reinforcement element 210 is disposed over second connection area 900 and first reinforcement element 208 is disposed over fourth connection area 902.

As described above, in some embodiments, the reinforcement elements may include a ridge that extends approximately through the middle of each reinforcement element to provide structural rigidity to the reinforcement element. For example, as shown in FIG. 9, second reinforcement element 210 includes first ridge 804 and first reinforcement element 208 includes a third ridge 912. Third ridge 912 may be formed in a substantially similar manner as first ridge 804 and/or second ridge 814, including similar materials, as described above.

In some embodiments, second reinforcement element 210 and/or first reinforcement element 208 may be provided with plurality of apertures 124, as described above, configured to receive a lace. In this embodiment, the portion of second reinforcement element 210 on lateral side 50 includes a ninth lace aperture 904 and a tenth lace aperture 906 that are disposed on one side of first ridge 804 (e.g., located above first ridge 804). The portion of second reinforcement element 210 on lateral side 50 also includes an eleventh lace aperture 908 and a twelfth lace aperture 910 that are disposed on an opposite side of first ridge 804 from ninth lace aperture 904 and tenth lace aperture 906 (e.g., located beneath first ridge 804). With this arrangement, a force applied to a lace extending through one or more of ninth lace aperture 904, tenth lace aperture 906, eleventh lace aperture 908, and twelfth lace aperture 910 may be distributed across second reinforcement element 210 on either side of first ridge 804.

Additionally, in this embodiment, first reinforcement element 208 includes a thirteenth lace aperture 914 and a fourteenth lace aperture 916 that are disposed on one side of third ridge 912 (e.g., located above third ridge 912) and a fifteenth lace aperture 918 and a sixteenth lace aperture 920 that are disposed on an opposite side of third ridge 912 from thirteenth lace aperture 914 and fourteenth lace aperture 916 (e.g., located beneath third ridge 912). With this arrangement, a force applied to a lace extending through one or more of thirteenth lace aperture 914, fourteenth lace aperture 916, fifteenth lace aperture 918, and sixteenth lace aperture 920 may be distributed across first reinforcement element 208 on either side of third ridge 912.

In some embodiments, a central portion of throat portion 400 of knitted workpiece 112, including lateral lobe 700, is substantially free of lace apertures. That is, as shown in FIG. 9, an area on knitted workpiece 112 that includes lateral lobe 700 located between first reinforcement element 208 and the portion of second reinforcement element 210 on lateral side 50 does not include any lace apertures of plurality of apertures 124. With this arrangement, lateral lobe 700 of knitted workpiece 112 may allow the sides of a foot of a wearer to flex and bulge when article 100 is worn during an activity, such as running or walking.

In some embodiments, the reinforcement elements on each of medial side 40 and lateral side 50 are symmetrical. That is, the generally curving U-shape of first reinforcement element 208 on lateral side 50 is substantially similar to the generally curving U-shape of third reinforcement element 212 on medial side 40. Additionally, the generally curving U-shape of second reinforcement element 210 is symmetrical on either side of center portion 220. In other embodiments, however, the reinforcement elements may have different or varied shapes, including asymmetrical arrangements between medial side 40 and lateral side 50 of upper 110.

Figure 10:
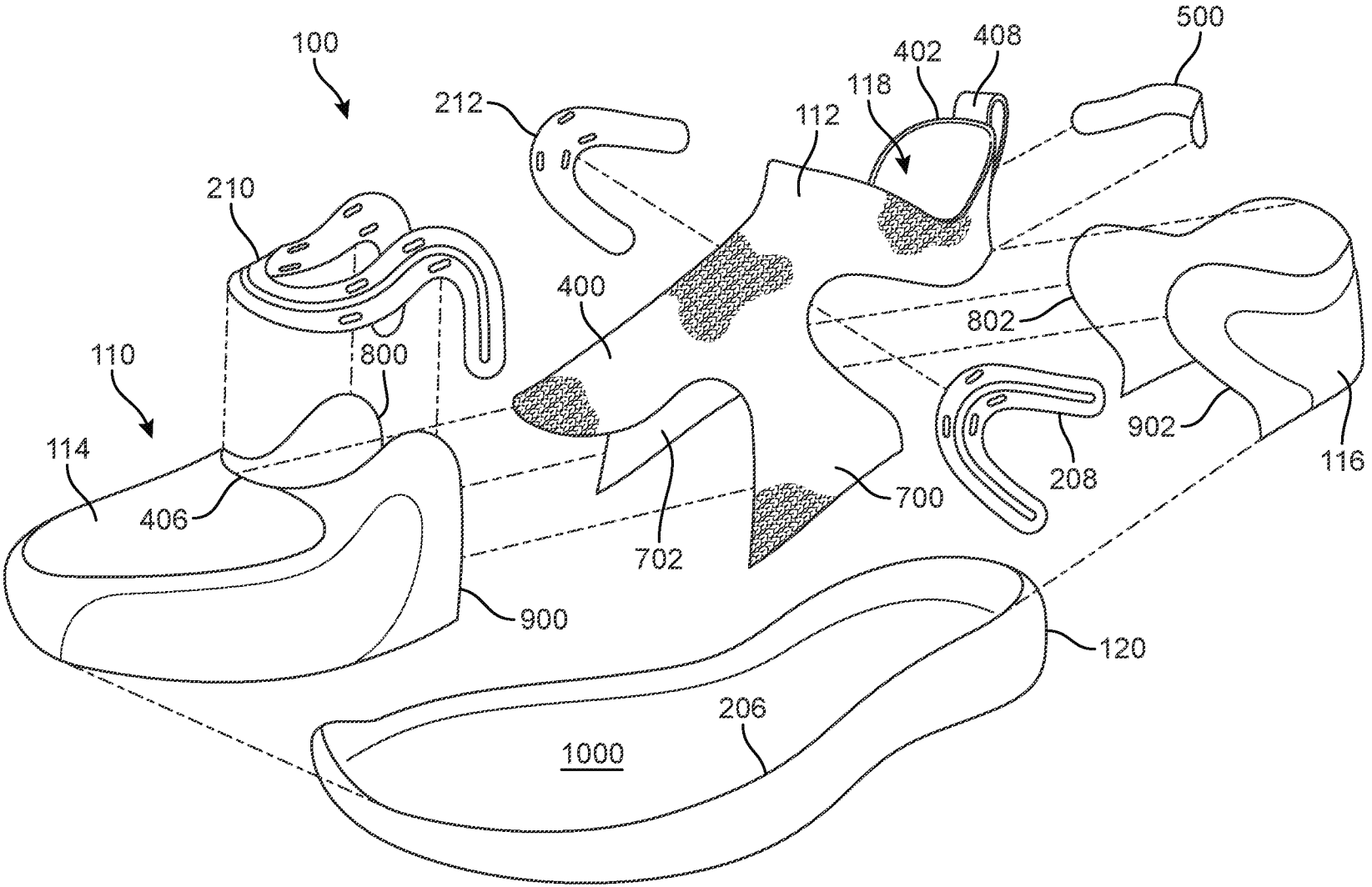
FIG. 10 is an exploded view of components of an example embodiment of an article of footwear including an upper incorporating a knitted butterfly workpiece.

FIG. 10 is an exploded view of components of the example embodiment of article of footwear 100 including upper 110 incorporating knitted butterfly workpiece 112. According to the techniques of the present embodiments described herein, an upper may be formed by a combination of multiple separate components, including at least one knitted workpiece. Each of the separate components forming the upper may be configured to provide different or varying properties or characteristics to the upper and the article formed therefrom. For example, the components may have different or varying amount of stretch resistance, durability, rigidity, support, comfort, and cushioning, as well as other properties or characteristics, and may be made or formed from different or varying materials.

In an example embodiment, upper 110 is formed at least by knitted workpiece 112, forefoot component 114, and heel component 116 which are joined or attached together to assemble upper 110. As shown in FIG. 10, forefoot component 114 is configured to join or attach to knitted butterfly workpiece 112 along a first connection area 800 and a second connection area 900 where front edges of lateral lobe 700 and medial lobe 702 of knitted butterfly workpiece 112 meet or abut with edges of forefoot component 114. Heel component 116 is configured to join or attach to knitted butterfly workpiece 112 along a third connection area 802 and a fourth connection area 902 where rear edges of lateral lobe 700 and medial lobe 702 of knitted butterfly workpiece 112 meet or abut with edges of heel component 116.

In some embodiments, knitted butterfly workpiece 112 has a lower degree or amount of stretch resistance than forefoot component 114 and/or heel component 116 so that portions of upper 110 in midfoot region 20 primarily formed by knitted butterfly workpiece 112 allow for movement of the foot of the wearer when article 100 is worn. For example, knitted butterfly workpiece 112 allows for flex and torsion of upper 110 in midfoot region 20 to accommodate changes in the shape of a foot of a wearer as the foot moves. In such embodiments, forefoot component 114 and/or heel component 116 may provide a greater degree or amount of stretch resistance so as to provide support and stability to the toes and heel of a foot of a wearer of upper 110 and article 100.

As shown in FIG. 10, additional components may be attached or joined with knitted workpiece 112, forefoot component 114, and heel component 116 as part of upper 110 and/or article 100. For example, as described above, reinforcement elements may be disposed over one or more of the connection areas between the separate components forming upper 110. In this embodiment, first reinforcement element 208 is configured to cover and reinforce fourth connection area 902 between edges of heel component 116 and lateral lobe 700 of knitted butterfly workpiece 112 on lateral side 50 and third reinforcement element 212 is configured to cover and reinforce third connection area 802 between edges of heel component 116 and medial lobe 702 of knitted butterfly workpiece 112 on medial side.

Second reinforcement element 210 is configured to cover and reinforce first connection area 800 and second connection area 900 between edges of forefoot component 114 and lateral lobe 700 and medial lobe 702. Additionally, second reinforcement element 210 covers over front end 406 of throat portion 400 of knitted butterfly workpiece 112 where the edge of throat portion 400 meets or abuts with the top edge of forefoot component 114. Additionally, as shown in FIG. 10, an overlay 500 may extend over and cover a connection area at the rear of article 100 where edges of collar portion 402 of knitted butterfly workpiece 112 meets or abuts with a top edge of heel component 116.

In an example embodiment, upper 110 may be configured to join or attach with sole assembly 120 to form article of footwear 100. For example, as shown in FIG. 10, an upper surface 1000 of sole assembly 120 may be attached to portions of upper 110, including portions of knitted workpiece 112, forefoot component 114, and/or heel component 116. In some cases, a strobel sock, sockliner, insole, midsole, or other component may be used to join bottom edges of knitted workpiece 112, forefoot component 114, and/or heel component 116 to enclose upper 110 and provide a mating surface between upper 110 and upper surface 1000 of sole assembly 120. In an example embodiment, bottom edges of lateral lobe 700 and/or medial lobe 702 are configured to terminate just past or adjacent to upper edge 206 of sole assembly 120 so that lateral lobe 700 and/or medial lobe 702 do not extend beneath a foot of a wearer of article of footwear 100 when worn.

Figure 11:
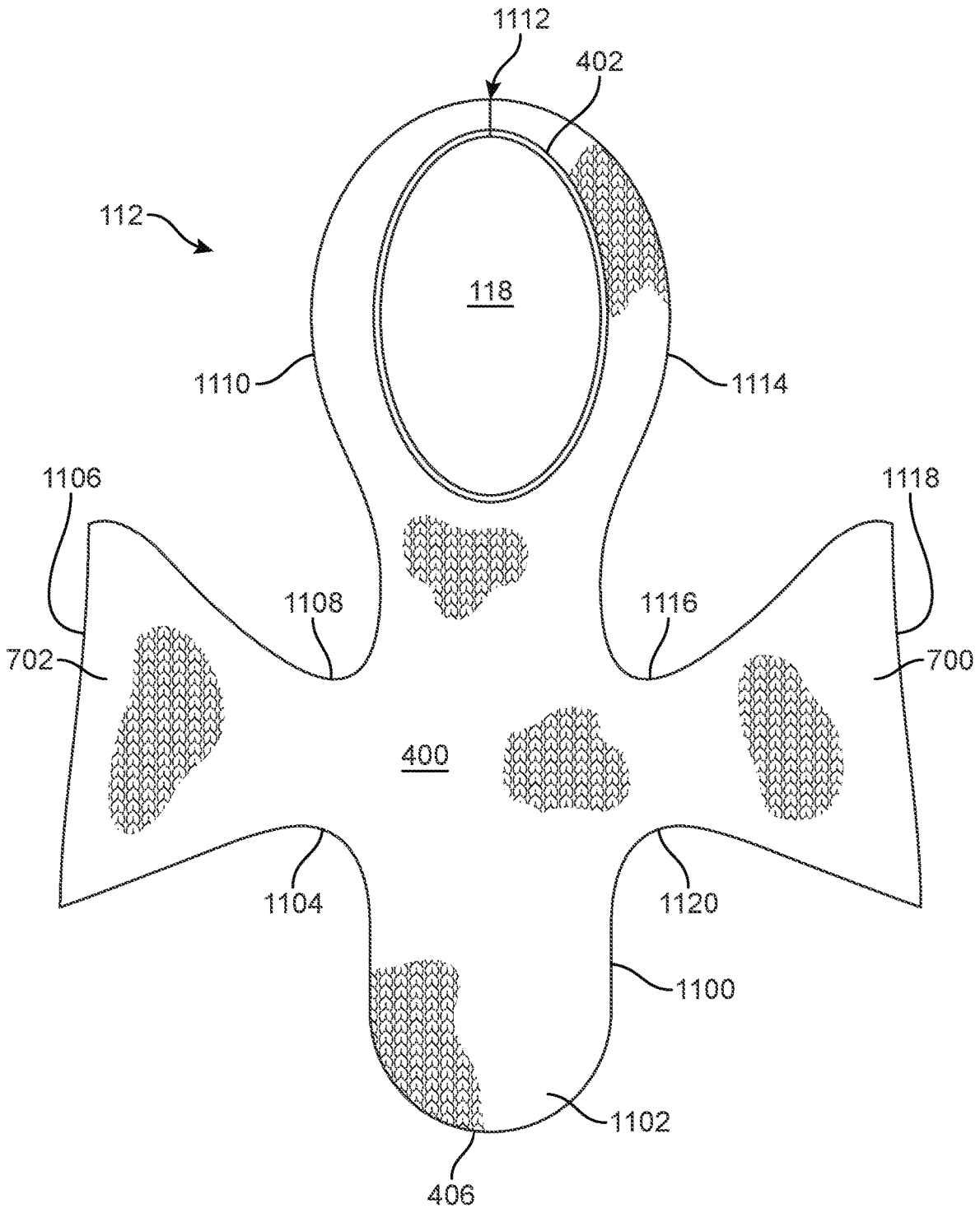
FIG. 11 is a representative plan view of an example embodiment of a knitted butterfly workpiece.

Referring now to FIG. 11, a representative plan view of an example embodiment of knitted workpiece 112 is shown in isolation from the other components of upper 110. In an example embodiment, knitted workpiece 112 is a single unified knitted workpiece formed of a unified knit composition made by a looping at least one continuous yarn/thread into a plurality of rows that define a shape of knitted workpiece 112. In this embodiment, knitted workpiece 112 has a butterfly shape with lateral lobe 700 that extends outward in a lateral direction from one side of throat portion 400 and medial lobe 702 that extends outward in a lateral direction from the opposite side of throat portion 400. That is, lateral lobe 700 and medial lobe 702 give an appearance of wings extending laterally outward from throat portion 400 to give knitted butterfly workpiece 112 its butterfly-like shape.

In one embodiment, rear edges of collar portion 402 of knitted butterfly workpiece 112 are attached or joined to each other to close and define opening 118. In an example embodiment, the medial collar rear edge and the lateral collar rear edge joined by a seam 1112 to define opening 118 of collar portion 402 for receiving a foot of a wearer.

As shown in FIG. 11, knitted butterfly workpiece 112 includes an outer peripheral edge 1100 that extends around a perimeter of knitted butterfly workpiece 112. In this embodiment, outer peripheral edge 1100 extends through front end 406 of an instep area 1102 of throat portion 400, extends in a direction away from front end 406 and changes direction at a front side edge 1104 of medial lobe 702. Outer peripheral edge 1100 continues from front side edge 1104 along a medial side edge 1106 of medial lobe 702 and changes direction at a rear side edge 1108 of medial lobe 702. Outer peripheral edge 1100 continues from rear side edge 1108 through a medial side edge 1110 of collar portion 402 to the medial collar rear edge where seam 1112 is located.

Continuing from the lateral collar rear edge of collar portion 402 on the opposite side of seam 1112, outer peripheral edge 1100 extends through a lateral side edge 1114 of collar portion 402 to a rear side edge 1116 of lateral lobe 700. Outer peripheral edge 1110 changes direction at rear side edge 1116 of lateral lobe 700 and extends forwards along a lateral side edge 1118 of lateral lobe 700. Outer peripheral edge 1100 changes direction again at a front side edge 1120 of lateral lobe 700 and continues along to front end 406 of instep area 1102 of throat portion 400.

The example embodiment of knitted butterfly workpiece 112 has a generally butterfly-like shape, as shown in the Figures. However, it should be understood that other shapes and arrangements of portions of a knitted workpiece (e.g., knitted workpiece 112) may be provided in various embodiments.

In some embodiments, portions of knitted butterfly workpiece 112 may have varying amounts or degrees of stretch resistance to provide different stretch zones to knitted butterfly workpiece 112. In one embodiment, the stretch resistance of lateral lobe 700 and medial lobe 702 may be different. For example, lateral lobe 700 may have a greater amount or degree of stretch resistance than medial lobe 702 (i.e., lateral lobe 700 stretches less than medial lobe 702) or medial lobe 702 may have a greater amount or degree of stretch resistance than lateral lobe 700 (i.e., medial lobe 702 stretches less than lateral lobe 700).

In another embodiment, a central portion of throat area 400 disposed between lateral lobe 700 and medial lobe 702 may have a different amount or degree of stretch resistance than other portions of knitted butterfly workpiece 112, such as instep area 1102, lateral lobe 700, medial lobe 702, and/or collar portion 402. For example, the central portion of throat area 400 between lateral lobe 700 and medial lobe 702 may have a greater amount or degree of stretch resistance than one or more of instep area 1102, lateral lobe 700, medial lobe 702, and/or collar portion 402 so that the central portion stretches less than the other portions of knitted butterfly workpiece 112. With this arrangement, upper 110 and article 100 may be provided with stretch zones of varying amounts or degrees of stretch resistance in different portions of knitted butterfly workpiece 112.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

The invention claimed is:

1. An upper of an article of footwear including a knitted workpiece, the knitted workpiece comprising:

a throat portion disposed in a midfoot region of the upper extending to a front end of the knitted workpiece;

a collar portion extending rearward from the throat portion at a forward end to a rear end opposite the forward end;

wherein the throat portion extends continuously from the forward end of the collar portion to the front end of the knitted workpiece in a longitudinal direction towards a forefoot region of the upper;

a medial lobe extending from one side of the throat portion;

a lateral lobe extending from an opposite side of the throat portion from the medial lobe;

wherein the throat portion, the collar portion, the medial lobe, and the lateral lobe form a single unified knitted workpiece;

the medial lobe including a front side facing towards the front end of the knitted workpiece and a rear side opposite the front side;

the lateral lobe including a front side facing towards the front end of the knitted workpiece and a rear side opposite the front side;

wherein an outer peripheral edge of the knitted workpiece extends along a front side edge on the front side of the medial lobe, a medial side edge of the medial lobe, and a rear side edge on the rear side of the medial lobe on one side of the upper;

wherein the outer peripheral edge of the knitted workpiece extends along a front side edge on the front side of the lateral lobe, a lateral side edge of the lateral lobe, and a rear side edge on the rear side of the lateral lobe on the opposite side of the upper;

wherein the front side edge of the medial lobe and the front side edge of the lateral lobe are located rearward of the front end of the throat portion in the longitudinal direction towards the collar portion of the upper; and wherein the rear side edge of the medial lobe and the rear side edge of the lateral lobe are located forward of the forward end of the collar portion in a direction towards the forefoot region of the upper.

2. The upper according to claim 1, wherein the medial lobe and the lateral lobe are symmetrical.

3. The upper according to claim 1, wherein the throat portion is at least partially located forward of the medial lobe and the lateral lobe in the longitudinal direction; and wherein the throat portion is also at least partially located rearward of the medial lobe and the lateral lobe in the longitudinal direction.

4. The upper according to claim 1, wherein the collar portion encircles an opening.

5. The upper according to claim 4, wherein rear edges of the collar portion are joined along a seam at the rear end of the collar portion.

6. The upper according to claim 5, wherein the collar portion is asymmetrical between a medial side and a lateral side.

7. The upper according to claim 6, wherein the collar portion includes a medial notch on the medial side and a lateral notch on the lateral side; and wherein the medial notch is located closer to the front end than the lateral notch along a longitudinal direction of the knitted workpiece.

8. The upper according to claim 1, wherein the outer peripheral edge further extends along a medial side edge of the collar portion and a lateral side edge of the collar portion.

9. The upper according to claim 8, wherein the outer peripheral edge changes direction at the front side edge on the front side of the medial lobe and the front side edge on the front side of the lateral lobe.

10. The upper according to claim 9, wherein the outer peripheral edge changes direction at the rear side edge on the rear side of the medial lobe and the rear side edge on the rear side of the lateral lobe.

11. The upper according to claim 1, wherein the throat portion includes a central portion located between the medial lobe and the lateral lobe.

12. The upper according to claim 1, wherein the throat portion, the collar portion, the medial lobe, and the lateral lobe forming the single unified knitted workpiece include at least one continuous yarn that is looped into a plurality of rows that define a shape of the knitted workpiece.

13. An upper of an article of footwear including a knitted workpiece, the knitted workpiece comprising:

a throat portion disposed in a midfoot region of the upper extending to a front end of the knitted workpiece;

a collar portion extending rearward from the throat portion at a forward end to a rear end opposite the forward end;

wherein the throat portion extends continuously from the forward end of the collar portion to the front end of the knitted workpiece in a longitudinal direction towards a forefoot region of the upper;

a medial lobe extending from one side of the throat portion;

a lateral lobe extending from an opposite side of the throat portion from the medial lobe;

wherein the throat portion, the collar portion, the medial lobe, and the lateral lobe form a single unified knitted workpiece;

the medial lobe including a front side facing towards the front end of the knitted workpiece and a rear side opposite the front side;

the lateral lobe including a front side facing towards the front end of the knitted workpiece and a rear side opposite the front side; and wherein the throat portion is between the rear side of the medial lobe and the rear side of the lateral lobe.

14. The upper according to claim 13, wherein a central portion of the throat portion is between the rear side of the medial lobe and the rear side of the lateral lobe; and wherein the medial lobe extends from a medial side of the throat portion forward of the collar portion in the midfoot region of the upper, and the lateral lobe extends from the opposite side of the throat portion from the medial lobe forward of the collar portion in a midfoot region of the upper.

15. The upper according to claim 13, wherein the collar portion encircles an opening.

16. The upper according to claim 15, wherein rear edges of the collar portion are joined along a seam at the rear end of the collar portion.

17. An upper of an article of footwear including a knitted workpiece, the knitted workpiece comprising:

a throat portion disposed in a midfoot region of the upper extending to a front end of the knitted workpiece;

a collar portion extending rearward from the throat portion at a forward end to a rear end opposite the forward end;

wherein the throat portion extends continuously from the forward end of the collar portion through the instep area of the upper to the front end of the knitted workpiece in a longitudinal direction towards a forefoot region of the upper;

a medial lobe extending outward in a medial direction from one side of the throat portion forward of the collar portion in the midfoot region of the upper and forming at least a portion of a medial side of the upper in the midfoot region;

a lateral lobe extending outward in a lateral direction from an opposite side of the throat portion from the medial lobe forward of the collar portion in the midfoot region of the upper;

wherein the throat portion, the collar portion, the medial lobe, and the lateral lobe form a single unified knitted workpiece;

the medial lobe including a front side facing towards the front end of the knitted workpiece and a rear side opposite the front side;

the lateral lobe including a front side facing towards the front end of the knitted workpiece and a rear side opposite the front side;

wherein the rear side of the medial lobe and the rear side of the lateral lobe are not present in a heel region of the upper; and wherein the throat portion is between the rear side of the lateral lobe and the rear side of the medial lobe.

18. The upper according to claim 17, wherein the lateral lobe and the medial lobe are configured to be joined to a separate forefoot component.

19. The upper according to claim 17, wherein the collar portion encircles an opening and rear edges of the collar portion are joined along a seam at the rear end of the collar portion.

* * * * *